US008458868B2

(12) United States Patent
Neumann et al.

(10) Patent No.: US 8,458,868 B2
(45) Date of Patent: Jun. 11, 2013

(54) SHOCK-PROOF SEAT BELT BUCKLE FOR A MOTOR VEHICLE

(75) Inventors: Anatoli Neumann, Barmstedt (DE); Matthieu Louvet, Lyons-la-Forêt (FR)

(73) Assignee: Autoliv Development AB, Vargarda (SE)

( * ) Notice: Subject to any disclaimer, the term of this patent is extended or adjusted under 35 U.S.C. 154(b) by 148 days.

(21) Appl. No.: 13/063,395

(22) PCT Filed: Oct. 15, 2009

(86) PCT No.: PCT/EP2009/007394

§ 371 (c)(1),
(2), (4) Date: Mar. 10, 2011

(87) PCT Pub. No.: WO2010/046052

PCT Pub. Date: Apr. 29, 2010

(65) Prior Publication Data

US 2011/0185546 A1 Aug. 4, 2011

(30) Foreign Application Priority Data

Oct. 23, 2008 (DE) ..... 10 2008 052 856

(51) Int. Cl.
*A44B 11/26* (2006.01)

(52) U.S. Cl.
USPC ..... 24/633

(58) Field of Classification Search
USPC ..... 24/633, 636–642
See application file for complete search history.

(56) References Cited

U.S. PATENT DOCUMENTS 5,195,224 A * 3/1993 Bock et al. ..... 24/641
5,765,266 A * 6/1998 Betz ..... 24/633

FOREIGN PATENT DOCUMENTS

DE 31 28 139 A1 3/1983
EP 0 507 266 B1 4/1992
WO WO 2006/114204 11/2006

OTHER PUBLICATIONS

PCT/EP2009/007394—International Search Report—Apr. 29, 2010.
International Search Report—Jan. 26, 2010.

* cited by examiner

*Primary Examiner* — James Brittain
(74) *Attorney, Agent, or Firm* — Brinks Hofer Gilson & Lione

(57) ABSTRACT

A shock-absorbing seat belt buckle (1) including is provided a housing, a push-button (2) displaceably mounted in the housing, a linearly guided inertia mass (3), and a transmission lever (4) pivot-mounted to the housing, which transmission lever is coupled to the inertia mass (3) by an arm (4*a*) and supports the push-button (2) against the opening direction with another arm (4*b*), wherein a sound-absorbing elastic layer (11) is provided between the transmission lever (4) and the inertia mass (3), at least in the region of contact between them.

4 Claims, 4 Drawing Sheets

SHOCK-PROOF SEAT BELT BUCKLE FOR A MOTOR VEHICLE

CROSS-REFERENCE TO RELATED APPLICATIONS

This application claims priority to German Patent Application No. 10 2008 052 856.0, filed Oct. 23, 2008 and PCT/EP2009/007394, filed Oct. 15, 2009.

FIELD OF THE INVENTION

The invention relates to a shock-absorbing seat belt buckle for a motor vehicle.

BACKGROUND OF THE INVENTION

Shock-absorbing seat belt buckles for motor vehicles are generally known and are preferably utilized in conjunction with a seat belt pretensioner that engages on the seat belt buckle via a pull cable and that has the function to take existing belt slack out of the safety belt, and to thereby couple the passenger to the vehicle deceleration preferably early.

From WO 2006/114204 A1, for example, a shock-absorbing seat belt buckle is known which comprises an inertia mass connected to the buckle release push-button via a transmission lever. The acceleration forces acting upon the inertia mass during the tensioning process are acting in the same direction as the acceleration forces acting upon the push-button and are transmitted to the same by a transmission lever against the opening direction of the push-button. It is thereby prevented that the push-button moves in the opening direction during the belt tensioning subjected to its own inertia forces, and thereby releases the seat belt buckle unintentionally. As the inertia mass, owing to its function to generate the required inertia forces, must have a certain self-weight, and as also the transmission lever must have a certain stability for the transmission of the arising forces, both components are preferably made of a metal. Furthermore, a small gap has to be provided between the linearly guided inertia mass and the transmission lever performing a rotation, so that the path of motion can be completed without clamping. This gap, particularly in the position of the inertia mass where no inertia forces are effective, leads to an undesired metallic rattling.

It is the object of the invention to improve a shock-absorbing seat belt buckle of the above-described kind in such a way that, even in its non-operated state, no undesired rattling noises can occur.

SUMMARY OF THE INVENTION

For the solution of the object, it is proposed that a sound-absorbing elastic layer is provided between the transmission lever and the inertia mass, at least in the region of the contact surface. By the proposed sound-absorbing elastic layer, the direct clash of the transmission lever and the inertia mass is prevented, thereby avoiding the undesired rattling noises. Furthermore, the path of motion during the mass balancing is not disturbed, as the sound-absorbing layer is designed elastically, and can thereby adjust to the motion.

A particularly simple and reliable embodiment of the invention is that the sound-absorbing elastic layer is formed by a rubber ring surrounding the inertia mass. The proposed rubber ring provides the advantage that it can be purchased at a low price as a mass-produced good, and that any kind of fastening, special working processes like injection-moulding or the like can be omitted, as it adheres to the inertia mass by itself.

The fastening of the rubber ring is preferably effected by the inertia mass comprising a groove in which the rubber ring is arranged, and by the depth of the groove being smaller than the thickness of the rubber ring. The rubber ring is secured against drifting aside by the groove and projects beyond the outer geometry of the inertia mass owing to the dimensioning of the groove, so that the coupled transmission lever, in any case, first comes into contact with the rubber ring and not with the inertia mass.

It is further proposed that the plane spanned by the rubber ring and the rotational axis of the transmission lever are perpendicular to each other. Thereby, a very small rubber ring can be utilized and it is still secured that the transmission lever is coupled to the inertia mass via the rubber ring during the entire performance of the rotational movement.

BRIEF DESCRIPTION OF THE INVENTION

In the following, the invention is described in more detail based on a preferred embodiment. The figures show in detail:

FIG. 1 shows a seat belt buckle with the push-button pushed-in;

FIG. 6 shows an oblique view of a seat belt buckle in accordance with this invention.

DETAILED DESCRIPTION OF THE INVENTION

Figure 1:
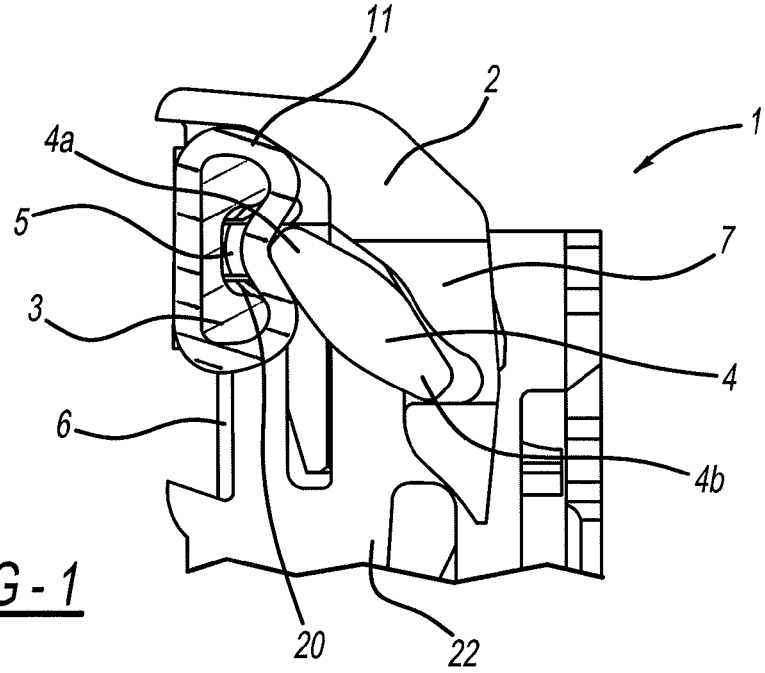

A seat belt buckle 1 according to the invention includes an inertia mass 3. The push-button 2 is displaceably guided on a frame 22 of the seat belt buckle 1, so that the seat belt buckle 1 can be released by means of pushing and displacing the push-button 2. Furthermore, a transmission lever 4 is pivot-mounted to the frame 22 of the seat belt buckle 1 in an opening 21, which transmission lever is coupled to the inertia mass 3 with one end 4*a* and which is coupled to the push-button 2 with the other end 4*b*. The inertia mass 3 moves in the opposite direction during the opening movement of the push-button 2, whereas the displacing movement of the push-button 2 is transmitted to the inertia mass 3 by the transmission lever 4.

The frame 22 mounting the mechanical mechanism and the housing of the seat belt buckle 1 enclosing the same can be considered as defined for the mechanism of the invention, so that the transmission lever 4, the inertia mass 3 and even the push-button 2 can, individually or jointly, be mounted to or guided on the frame 22 as well as directly mounted to or guided on the housing, without departing from the concept of the invention.

The inertia mass 3 is provided with recesses 8 and 9 in which the guides 6 of the push-button 2 and the pieces of the frame 22 engage, so that the inertia mass 3 is guided in relation to the push-button 2 and to the frame 22.

Figure 2:
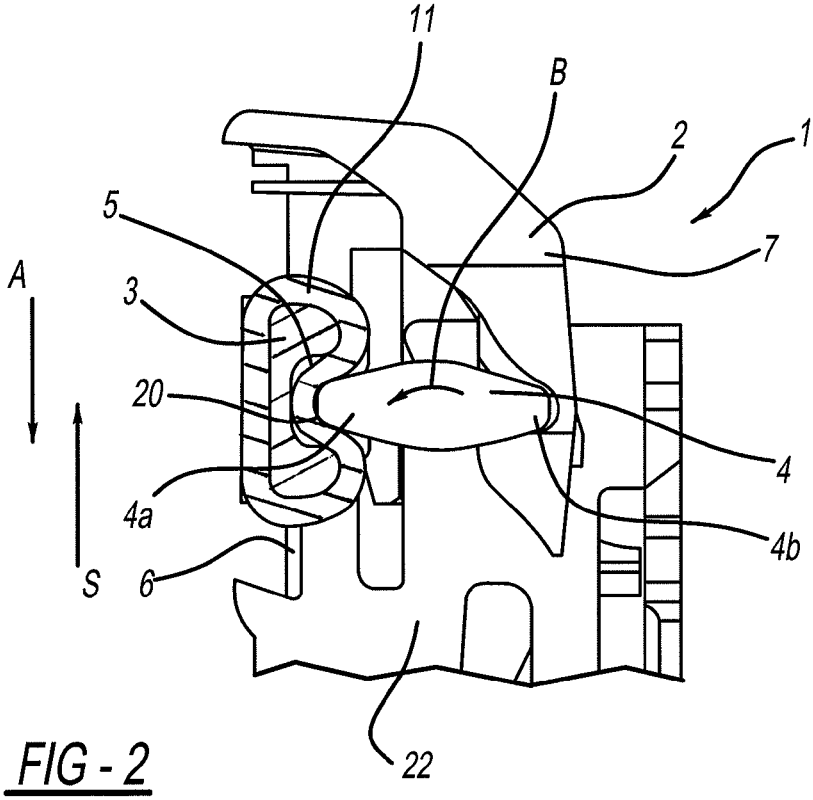
FIG. 2 shows a seat belt buckle in its non-operated state.
Figure 3:
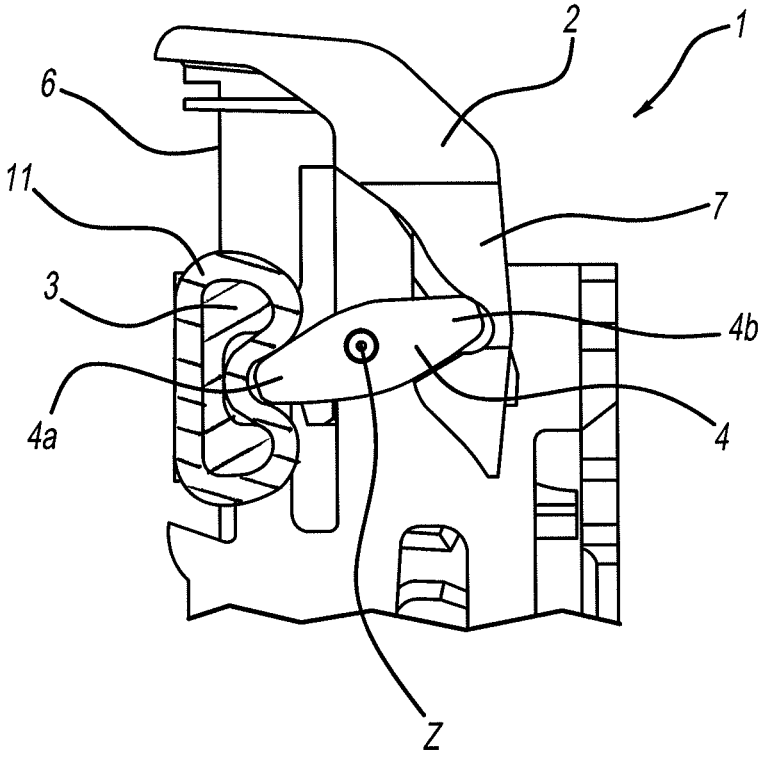
FIG. 3 shows a seat belt buckle at the end of the mass balancing movement.

FIGS. 1 to 3 show the mechanism of the shock-absorbing seat belt buckle 1 with transmission lever 4 and inertia mass 3 in different positions. FIG. 1 shows the position of the seat belt buckle 1 with the push-button 2 pushed-in, wherein the inertia mass 3 is moved in the direction of the push-button 2 and rests against the same. FIG. 2 shows the seat belt buckle 1 before the start of the tensioning movement, i.e. in its non-operated state. This position is given with the belt tongue inserted as well as with the belt tongue non-inserted. Finally, FIG. 3 shows the shock-absorbing seat belt buckle 1 in the end position of the mass balancing movement.

A push-button 2 and an inertia mass 3 are shown in detail which are mounted to a frame 22 of the seat belt buckle 1. The housing of the seat belt buckle 1 is not shown, as the same is not altered by the invention and, besides, would only adversely affect the visibility of the invention. A transmission lever 4 is arranged between the push-button 2 and the inertia mass 3, which transmission lever is pivot-mounted to the frame 22 of the seat belt buckle 1.

The inertia mass 3 is linearly guided on a guide 6 on the push-button 2 parallel to the insertion direction, so that the acceleration forces acting upon the inertia mass 3 and upon the push-button 2 are acting in the same direction. The inertia mass 3 is further provided with a recess 5, in which the transmission lever 4 engages with its lever end 4*a*. In order that the relative movement between the transmission lever 4 and the inertia mass 3 is effected without the risk of clamping, a gap 20 is provided between the lever end 4*a* and the inertia mass 3. Furthermore, a sound-absorbing elastic layer 11 in the form of a rubber ring is provided between the lever end 4*a* and the inertia mass 3. In case, the seat belt buckle 1, in this position, is exposed to vibrations, the layer 11 prevents the inertia mass 3 and the transmission lever 4 from clashing and causing a metallic rattling. The other lever end 4*b* of the transmission lever 4 faces the push-button 2 and is located beneath a projection 7 of the push-button 2.

In case, the seat belt buckle 1 is suddenly accelerated in the direction "A" by means of the tensioning process, and is suddenly decelerated upon completion of the tensioning movement, what corresponds to a negative acceleration in the direction "S", both the push-button 2 and the inertia mass 3 are exposed to inertia forces in the direction "A" by means of the sudden deceleration. The inertia mass 3 is moved in the arrow direction "A" by the acting inertia forces and sets the transmission lever 4 into a counter-clockwise rotational movement in the arrow direction "B" from the position shown in FIG. 2 to the position shown in FIG. 3 by engagement of the lever end 4*a* in the recess 5.

Due to the rotational movement the arm 4*b* contacts the projection 7, and thereby supports the push-button 2, so that the same cannot perform a movement in the arrow direction "A" and does not release the seat belt buckle. In fact, the push-button 2 is moved in the opposite direction against its opening direction by the transmission lever 4 by means of the movement of the inertia mass 3 in the arrow direction "A". During the rotational movement of the transmission lever 4 to the position shown in FIG. 3, the layer 11 in the form of the elastic rubber ring is pushed into the recess 5, in other words, it is compressed elastically itself, so that the movement is not disturbed. In order that, in any case, the inertia mass 3, and not the push-button 2, performs the movement in the arrow direction "A", its mass is intentionally dimensioned in such a way that the torque exerted on the transmission lever 4 at least corresponds to the torque exerted by the push-button 2.

FIG. 3 shows the movement in the state of the end of the mass balancing. The rotational axis "Z" of the transmission lever 4 protruding from the representation level perpendicular to the plane spanned by the layer 11, respectively by the rubber ring, can be seen, which plane is identical to the representation level. Thereby, a small cost-effective rubber ring can be utilized for the layer 11 and it is still secured that the sound-absorbing elastic layer 11 is present between the transmission lever 4 and the inertia mass 3 during the entire rotational movement of the transmission lever 4.

Figure 4:
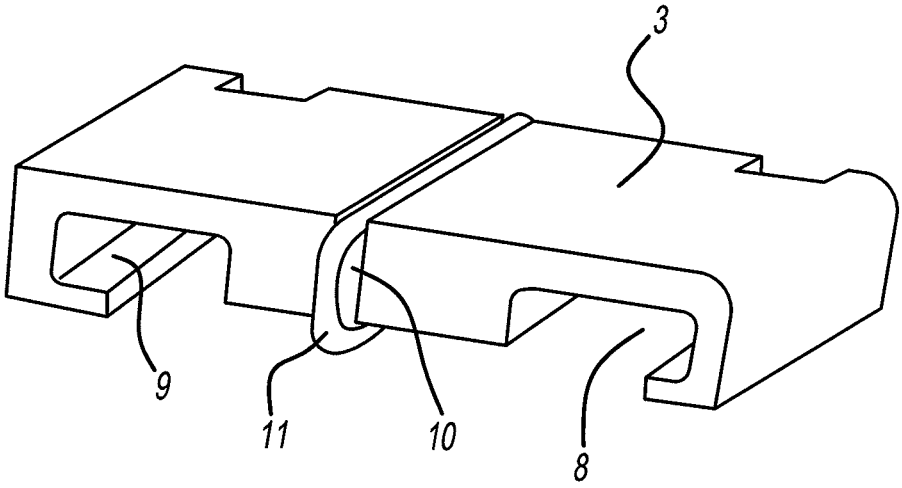
FIG. 4 shows an inertia mass with a rubber ring.
Figure 5:
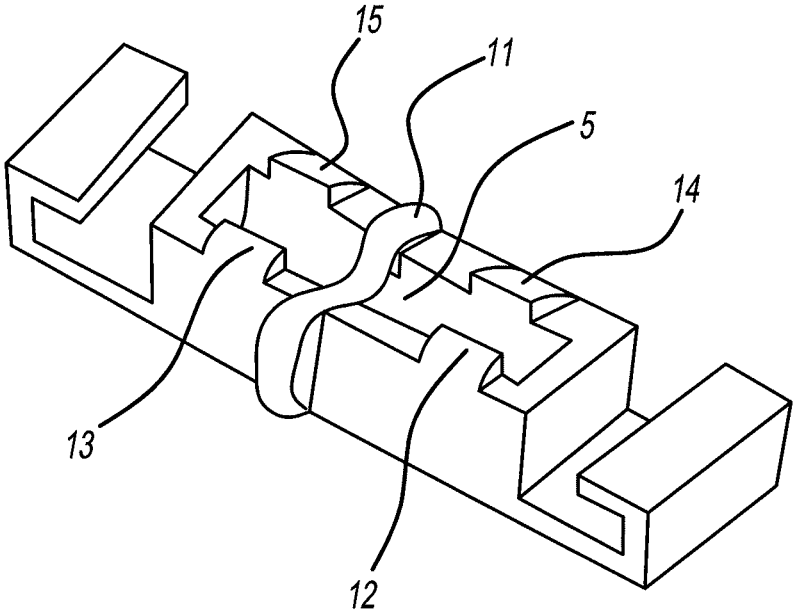
FIG. 5 is a bottom view of the inertia mass with the rubber ring.
Figure 6:
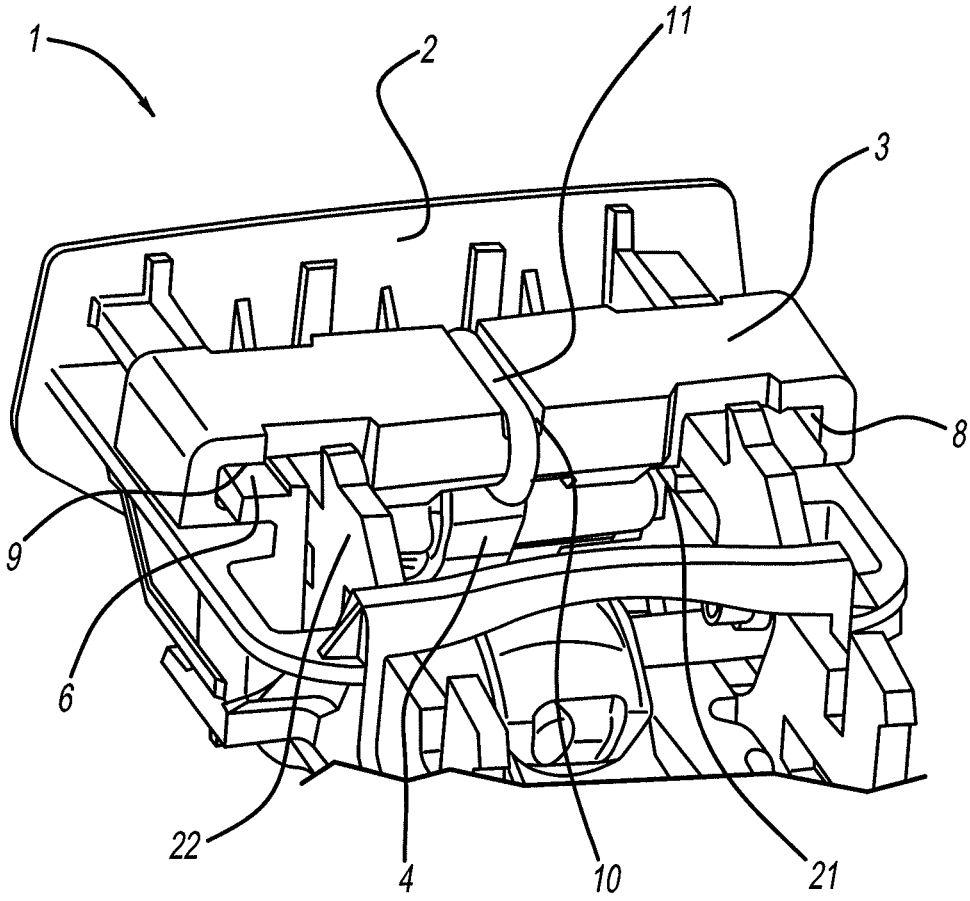
FIG. 6 is an oblique view of seat belt buckle with inertia mass.

FIGS. 4 and 5 show the inertia mass 3 with the rubber ring arranged thereon as sound-absorbing layer 11 in different views. The inertia mass 3 comprises recesses 8 and 9 laterally on its bottom in which recesses the inertia mass 3 is linearly guided parallel to the insertion direction of the push-button on the push-button 2, on the frame 22 and/or on a housing of the seat belt buckle 1 not shown.

Approximately in its centre, a groove 10 is provided in which a rubber ring acting as sound-absorbing layer 11 is arranged. The depth of the groove 10 is smaller than the thickness of the rubber ring, so that the same projects beyond the outer contour of the inertia mass 3. On the rear side of the inertia mass 3, a recess 5 can be seen, in which the lever end 4*a* of the transmission lever 4 engages. Laterally to the recess 5, additionally, lobes 12, 13, 14 and 15 are provided, which embrace the lever end 4*a* upon the engagement of the lever end 4*a*, so that the transmission lever 4 and the inertia mass 3 cannot disengage during the entire path of motion. Owing to the recess 5 the lever end 4*a* can push in the rubber ring, and the rubber ring, due to its permanent attachment to the lever end 4*a*, exerts a pre-stressing on the same, so that all components act rattling-free upon each other.

While the above description constitutes the preferred embodiment of the present invention, it will be appreciated that the invention is susceptible to modification, variation, and change without departing from the proper scope and fair meaning of the accompanying claims.

The invention claimed is:

1. A shock-absorbing seat belt buckle (1) comprising:

a housing, a push-button (2) displaceably mounted in the housing, a linearly guided inertia mass (3), a transmission lever (4) pivotably mounted to the housing, the transmission lever being coupled to the inertia mass (3) by a first end of the lever (4*a*) and supporting the push-button (2) against the opening direction with a second end of the lever (4*b*), and a sound-absorbing elastic layer (11) arranged between the transmission lever (4) and the inertia mass (3) in the region of contact between the transmission lever (4) and the inertia mass (3), the sound-absorbing elastic layer (11) being formed by a rubber ring wrapped around the inertia mass (3).

2. The shock-absorbing seat belt buckle (1) according to claim 1, further comprising that the inertia mass (3) forms a groove (10) in which the rubber ring is arranged, and that the depth of the groove (10) is smaller than the thickness of the rubber ring.

3. The shock-absorbing seat belt buckle (1) according to claim 1 further comprising that a plane spanned by the rubber ring and a pivot axis of the transmission lever (4) are perpendicular to each other.

4. The shock-absorbing seat belt buckle (1) according to claim 1 further comprising that the transmission lever (4) engages in a recess (5) on the inertia mass (3), and that the sound-absorbing elastic layer (11), at least partly, fills the recess (5).

* * * * *